US009252469B2

(12) United States Patent
Kleine

(10) Patent No.: US 9,252,469 B2
(45) Date of Patent: Feb. 2, 2016

(54) MICROWAVE CIRCUIT IN STRIP LINE TECHNOLOGY

(71) Applicant: Rohde & Schwarz GmbH & Co. KG, Munich (DE)

(72) Inventor: Gregor Kleine, Wolfratshausen (DE)

(73) Assignee: ROHDE & SCHWARZ GMBH & CO. KG, Munich (DE)

( * ) Notice: Subject to any disclaimer, the term of this patent is extended or adjusted under 35 U.S.C. 154(b) by 509 days.

(21) Appl. No.: 13/670,157

(22) Filed: Nov. 6, 2012

(65) Prior Publication Data

US 2013/0135061 A1 May 30, 2013

(30) Foreign Application Priority Data

Nov. 24, 2011 (EP) ..... 11190497

(51) Int. Cl.
*H01P 1/203* (2006.01)
*H01P 7/08* (2006.01)

(52) U.S. Cl.
CPC ..... *H01P 1/20336* (2013.01); *H01P 7/08* (2013.01)

(58) Field of Classification Search
CPC ..... H01P 1/20336; H01P 7/082
USPC ..... 333/204, 205, 219, 235
See application file for complete search history.

(56) References Cited

U.S. PATENT DOCUMENTS

2006/0250199 A1* 11/2006 Ohwada et al. ..... 333/204
2007/0080760 A1 4/2007 Alford

FOREIGN PATENT DOCUMENTS

DE 3132930 A1 3/1983
FR 2959908 A1 11/2011

* cited by examiner

*Primary Examiner* — Robert Pascal
*Assistant Examiner* — Gerald Stevens
(74) *Attorney, Agent, or Firm* — Ditthavong & Steiner, P.C.

(57) ABSTRACT

A microwave circuit in strip line technology contains metallic resonator strips on one side of a dielectric layer. Alternatively another end of consecutive resonator strips is connected by means of at least one via to a metallic surface on an opposite side of said dielectric layer. Said end of each resonator strip is connected to at least one via and is formed relative to said at least one via so that the effective electrical length of each resonator strip connected through the via is identical.

7 Claims, 9 Drawing Sheets

MICROWAVE CIRCUIT IN STRIP LINE TECHNOLOGY

The invention relates to a microwave circuit in strip line technology.

Microwave circuits in strip line technology filtering or coupling microwave signals contain metallic resonator strips on a dielectric layer substrate as shown for example in DE 31 32 930 A1.

Figure 1:
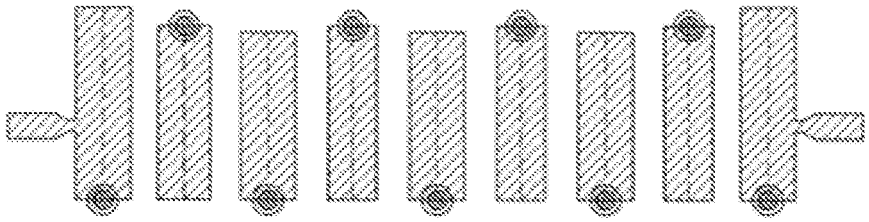
Fig. 1 BACKGROUND ART

An interdigital filter of $9^{th}$ order according to FIG. 1 comprises 9 parallel resonator strips with one end connected to a ground contact at the opposite side of the layer substrate by means of a via and one open end. The position of the end connected to the ground contact and the position of the open end are alternately changed within the sequence of the resonator strips.

Figure 2:
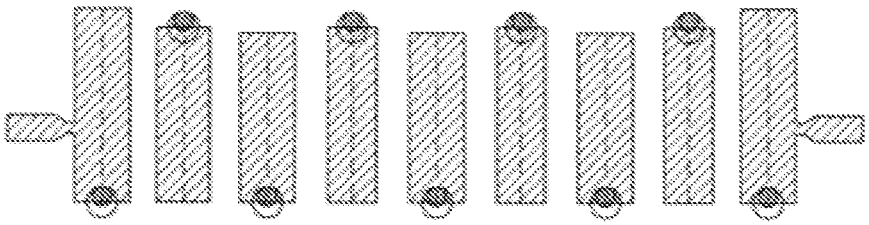
Fig. 2 BACKGROUND ART

The production of such a microwave circuit contains the process step of processing the metallic resonator strips on the upper surface of the dielectric layer substrate and the process step of drilling and metalizing the via in the layer substrate. Both process steps are performed independently to each other typically leading to a deviation between the actual position of each via and the optimal position of each via in relation to the connecting resonator strip as shown in FIG. 2. It is evident that the deviation equally affects the position of each via in relation to its corresponding resonator strip, whereas the tolerance in the distances between the positions of each via is negligibly small.

The resonance frequency of a resonator strip depends on the geometry of a resonator strip and is additionally influenced by the geometry of the via and by the position of the via in relation to the resonator strip. Thus, the resonance frequency of a resonator strip connected to a via is reduced in comparison to the resonance frequency of a resonator strip without any connection to a via. In an interdigital filter with deviation between the actual position and the optimal position of the vias in relation to the corresponding resonator strips according to FIG. 2 the effective electrical length of the first resonator strips connected to a via—i.e. the first, the third, the fifth and so on resonator strip from the left side of the interdigital filter—is reduced in comparison to the resonator strips connected to a via without deviation. Thus, the resonance frequency of that first resonator strips connected to a via is enlarged in comparison to a resonator strip connected to a via without deviation. In FIG. 2 the effective electrical length of the second resonator strips connected to a via—i.e. the second, the fourth, the sixth and so on resonator strip from the left side of the interdigital filter—is enlarged in comparison to a resonator strip connected to a via without deviation. Thus, the resonance frequency of that second resonator strips connected to a via is reduced in comparison to a resonator strip connected to a via without deviation.

Figure 3A:
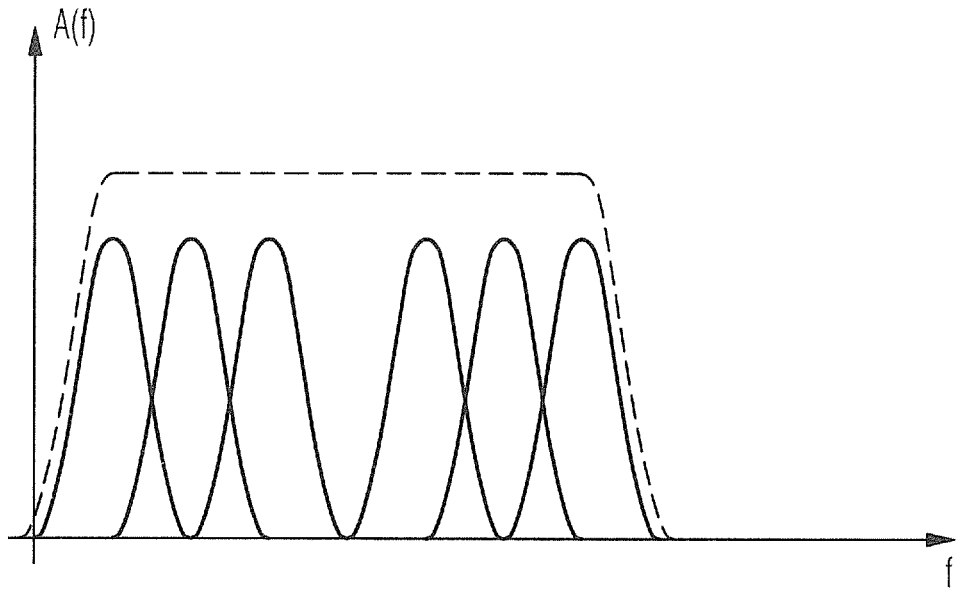
Figure 3B:
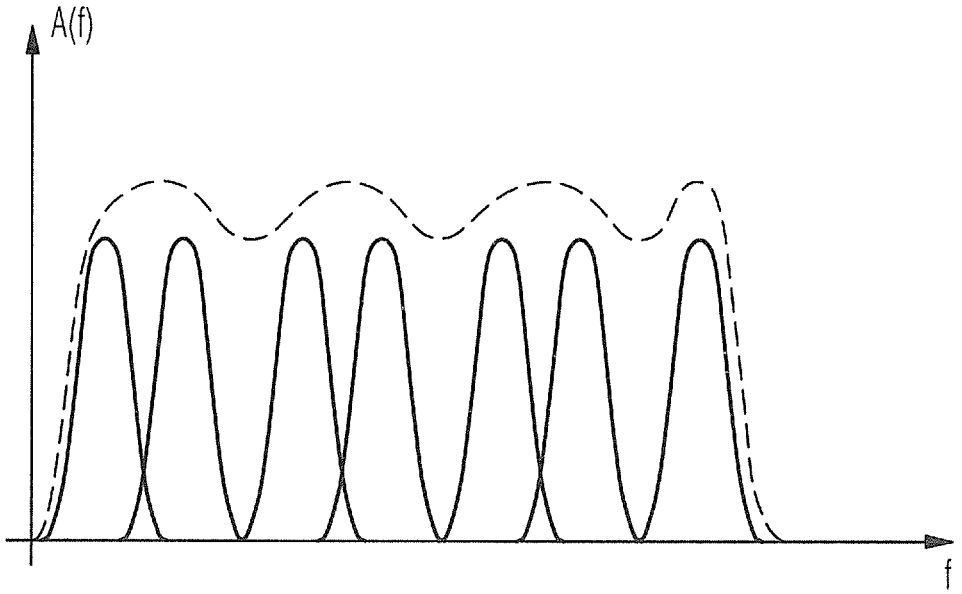

The frequency response of the transmission characteristic of an interdigital filter comprising several resonator strips is determined by the different resonance frequencies of the resonator strips and the electromagnetic coupling between the parallel resonator strips depending on the distance between two consecutive resonator strips. FIG. 3A schematically illustrates the frequency response of the transmission characteristic of such an interdigital band pass filter (dotted line) resulting from the summed transmission characteristics of each resonator strip at its specific resonance frequency in case of correctly positioned vias relatively to the resonator strips. FIG. 3B schematically shows the frequency response of the transmission characteristic of such an interdigital filter in case of vias with intolerant positions relatively to the resonator strips. The frequency response of the transmission characteristic of the interdigital filter in FIG. 3B is characterized by drops in the bandwidth of the band pass filter.

Figure 4:
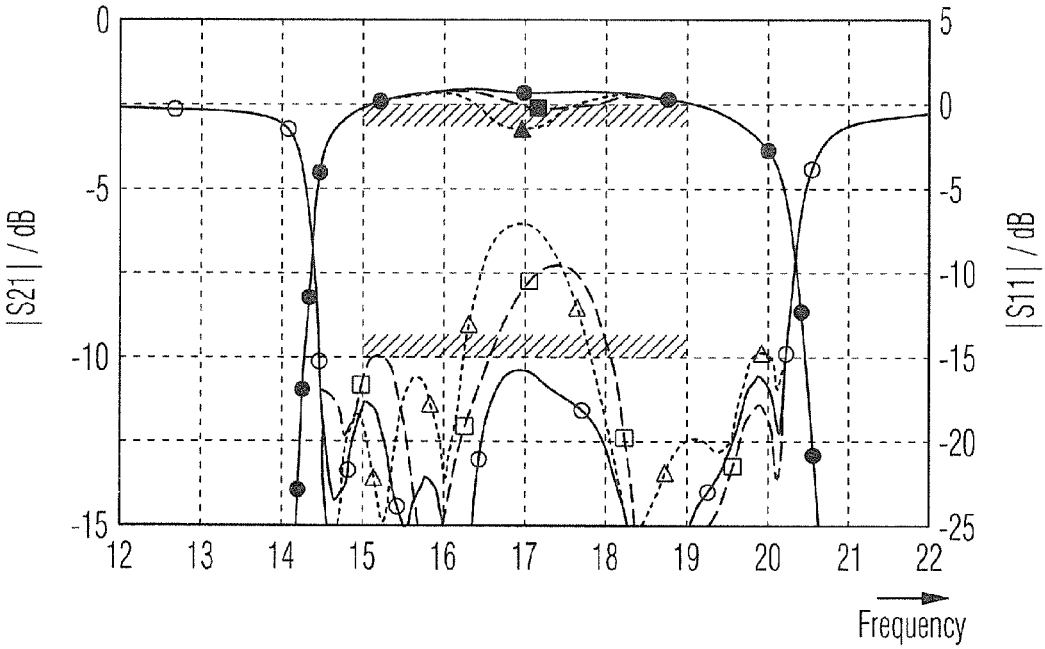

A frequency response of the transmission characteristic—i.e. of the insertion loss $S_{21}$—and of the reflection characteristic—i.e. of the return loss $S_{11}$—of a band pass filter is shown in FIG. 4. The frequency response shown in FIG. 4 shows the insertion loss $S_{21}$ of a band pass filter without deviation between the optimal and the actual positions of the vias (Symbol: ●) and the return loss $S_{11}$ of a band pass filter without deviation between the optimal and the actual position of the vias (Symbol: o). A drop in the frequency response of the insertion loss $S_{21}$ of a band pass filter in case of vias with a deviation of 16 μm above their optimal positions (Symbol: ■) and a drop in the frequency response of the insertion loss $S_{21}$ of a band pass filter in case of vias with a deviation of 16 μm below their optimal positions (Symbol: ▲) can be seen in FIG. 4. A rise in the frequency response of the return loss $S_{11}$ of a band pass filter in case of vias with a deviation of 16 μm above their optimal positions (Symbol: □) and a rise in the frequency response of the return loss $S_{11}$ of a band pass filter in case of vias with a deviation of 16 μm below their optimal position (Symbol: Δ) can also be seen in FIG. 4.

The problem of enlarging or reducing the effective electrical length of a resonator strip in case of a deviation of the actual position from the optimal position of a via relative to a resonator strip could be solved by using at least two vias at one end of a resonator strip. By using several vias at one end of a resonator strip the influence of the vias to the enlargement of the effective electrical length of a resonator strip can be reduced. However, the use of several vias at one end of a resonator strip is often not possible because a minimum distance between the vias has to be considered in the production of microwave circuits.

Therefore, the object of the invention is to develop a microwave circuit in strip line technology with minimized degradations in the frequency response in case of deviations in the positions of the vias in relation to the corresponding resonator strips.

The object is solved by a microwave circuit in strip line technology with the features of claim 1. Advantageous technical improvements can be carried out by the subject matters of the dependent claims.

According to the invention, the end of each resonator strip connected to at least one via in the microwave circuit is formed, so that the effective electrical length of each resonator strip in combination with at least one via is identical.

In a first and second preferred embodiment of the invention, the end of each resonator strip connected to one via is formed so that the end of each resonator strip is positioned in the same direction relative to its corresponding via. If each via has the same deviation from its corresponding resonator strip, the same direction of each via relative to its corresponding resonator strip results in an identical effective electrical length of each resonator strip in combination with the corresponding via. Thus, an identical deviation of each via in relation to its corresponding resonator strip leads to an identical shift in the effective electrical length of each resonator strip in combination with its via and thus to an identical shift in the resonance frequency of each resonator strip in combination with its via. The band pass filter spectrum of such an inventive microwave circuit does not have any distinct drops. It is only shifted in its central frequency corresponding to the identical frequency shift in the resonance frequency of each resonator strip.

In the first preferred embodiment of the invention, the end of each second consecutive resonator strip is elongated to a loop-shaped elongated resonator strip, whereby an open end of the loop-shaped elongated resonator strip is located opposite to the former resonator strip and is connected to one via.

In the second preferred embodiment of the invention, the end of each second consecutive resonator strip is elongated to a ring-shaped elongated resonator strip, whereby an open end of the ring-shaped elongated resonator strip is located opposite to the preceding resonator strip at an inner line of the ring-shaped elongated resonator strip and is connected to one via.

By using such a design for the end of each second consecutive resonator strip, the end of each second consecutive resonator strip is positioned in the same direction relative to its corresponding via as the resonator strips positioned intermittent to the second consecutive resonator strips.

In a third, fourth and fifth preferred embodiment of the invention, one end of each resonator strip is split into two extension resonator strips. The open end of each extension resonator strip is connected to one via. The design of the two extension resonator strips is elected in such a manner that the averaged enlargement of the effective electrical length in the resonator strip resulting from the two extension resonators strips is constant for each position of the resonator strips relative to the at least one corresponding via.

In this case the effective electrical length in each resonator strip is identical resulting in an identical resonance frequency of each resonator strip in the microwave circuit. Thus, the band pass filter spectrum of such an inventive microwave circuit does not have any distinct drops. The constant effective electrical length of each resonator strip for different positions of the resonator strip relative to the via results in a constant central frequency of the band pass filter spectrum for each position of the resonator strips relative to the at least one corresponding via.

The two extension resonator strips have an identical form and an identical size resulting in a constant averaged enlargement of the effective electrical length of the enlarged resonator strip for each position of the resonator strip relative to the at least one corresponding via.

In the third preferred embodiment of the invention the two extension resonator strips are disposed perpendicularly to the resonator strip in opposite direction to each other resulting in enlargements of the effective electrical length in the enlarged resonator strips each comprising the preceding resonator strip and one extension resonator strip being symmetrical to the averaged enlargement of the effective electrical length in the enlarged resonator strip for each position of the resonator strip relative to the at least one corresponding via.

Enlargements of the effective electrical length in the enlarged resonator strips each comprising the preceding resonator strip and one extension resonator strip being symmetrical to the averaged enlargement of the effective electrical length in the enlarged resonator strip for each position of the resonator strip relative to the at least one corresponding via is realized in the preferred fourth embodiment of the invention by means of two extension resonator strips each having a parallel orientation to the resonator strip at of its open end. Furthermore, in the fourth embodiment of the invention, one extension resonator strip has an equal orientation to the resonator strip at the portion of its open end and the other extension resonator strip has an opposite orientation to the resonator strip at its open end.

In the preferred fifth embodiment of the invention, the two extension resonator strips represent the halves of a ring-shaped resonator strip. The open end of each extension resonator strip is connected to a different section of a common via. Thus, the enlargements of the effective electrical length in the enlarged resonator strips each comprising the preceding resonator strip and one extension resonator strip are symmetrical to the averaged enlargement of the effective electrical length in the enlarged resonator strip for each position of the resonator strip relative to the common via.

Figure 5A:
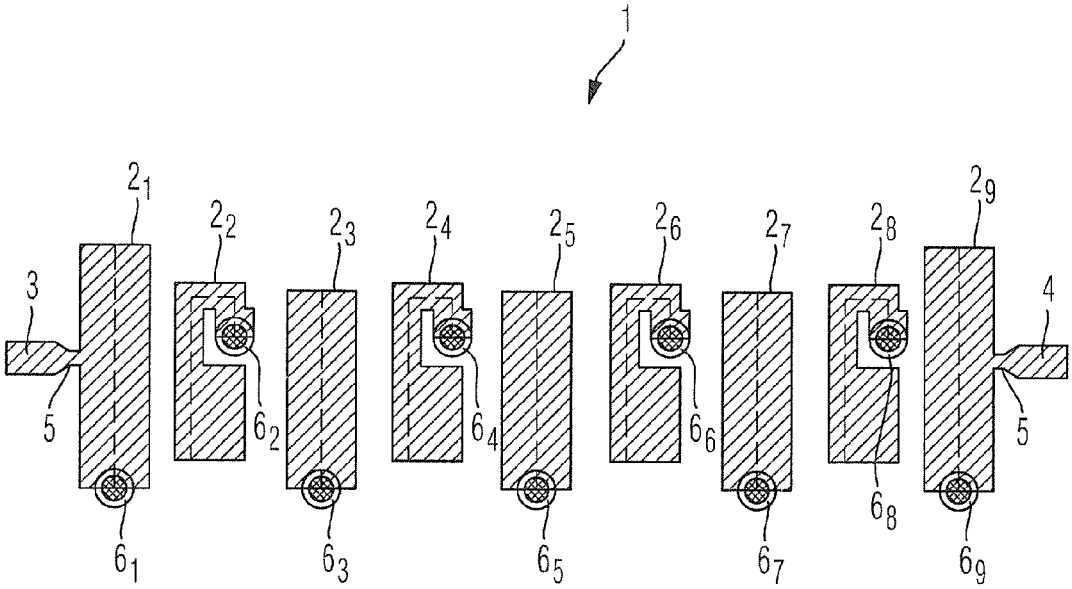
Figure 5B:
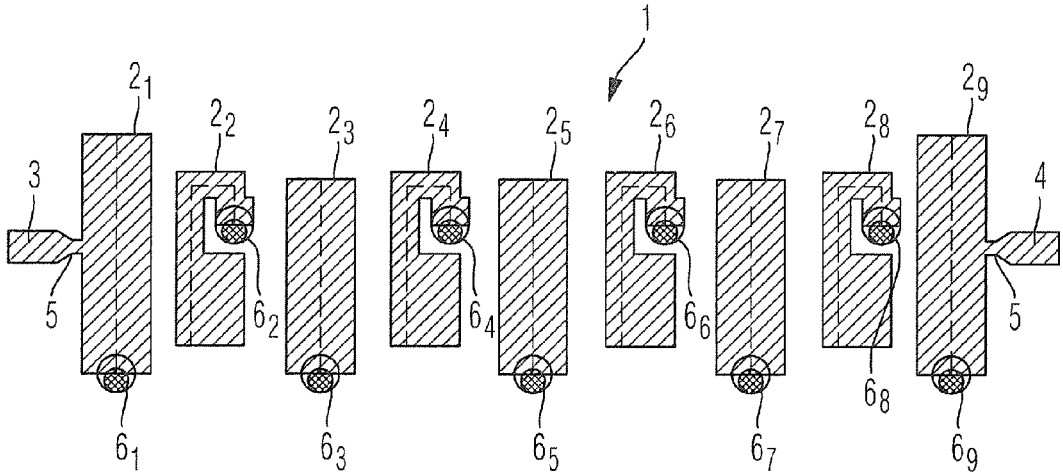
Figure 6A:
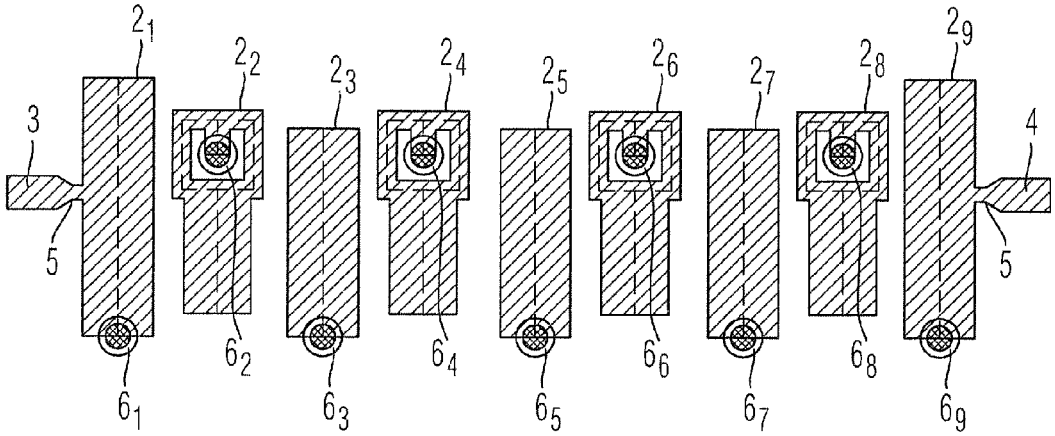
Figure 6B:
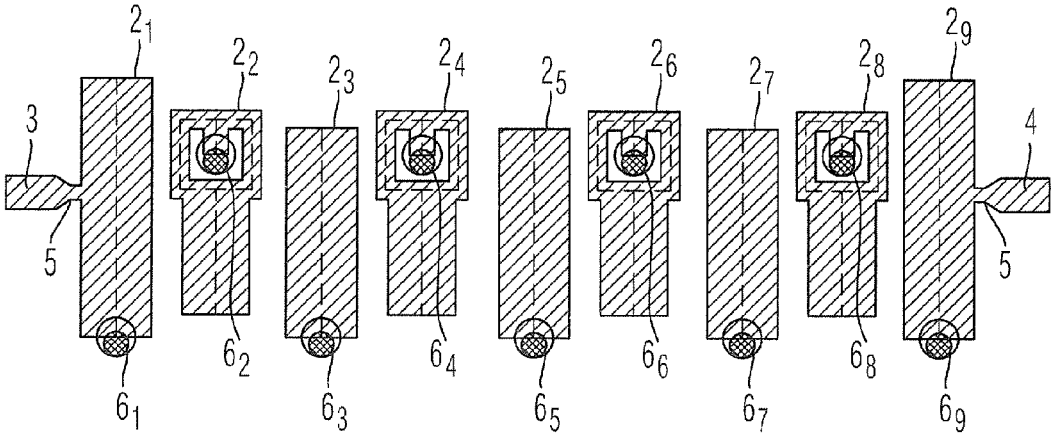
Figure 7A:
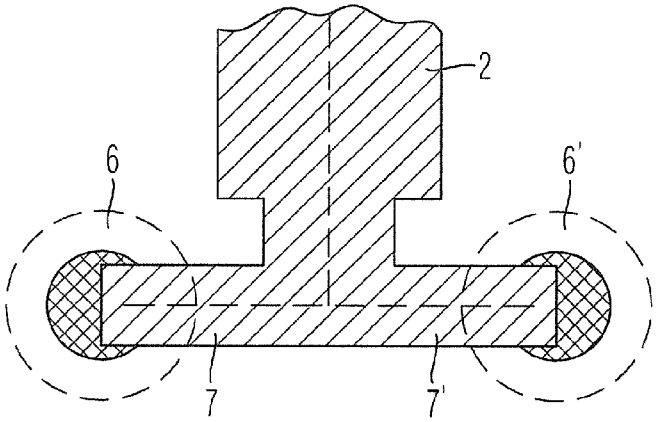
Figure 7B:
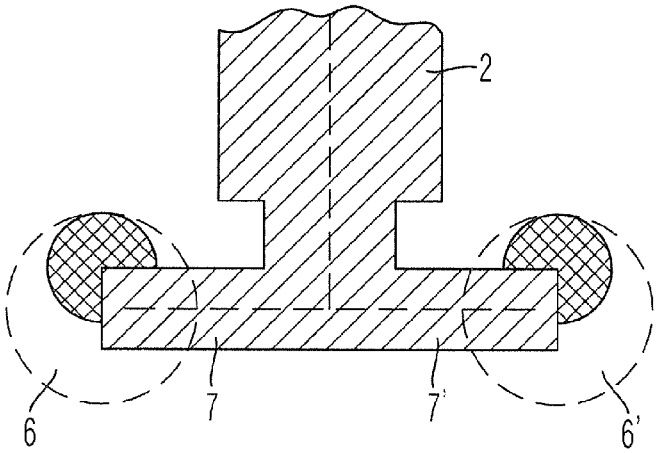
Figure 7C:
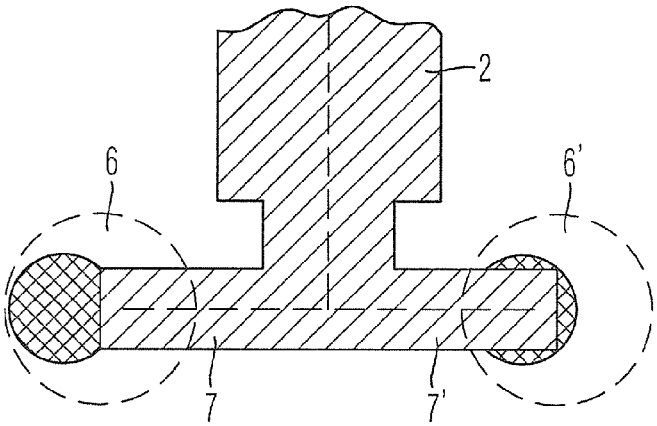
Figure 8A:
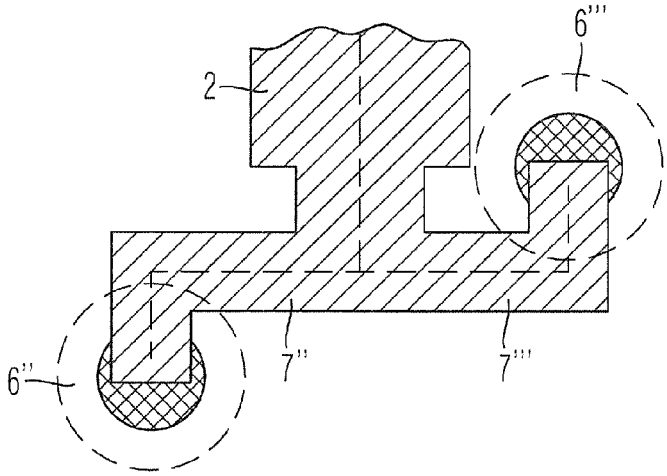
Figure 8B:
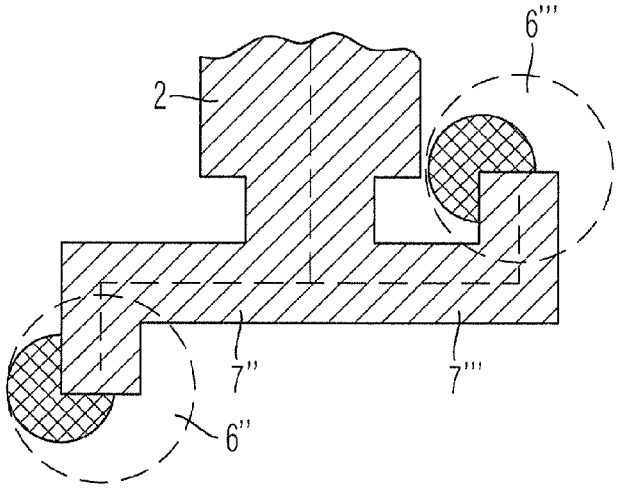
Figure 8C:
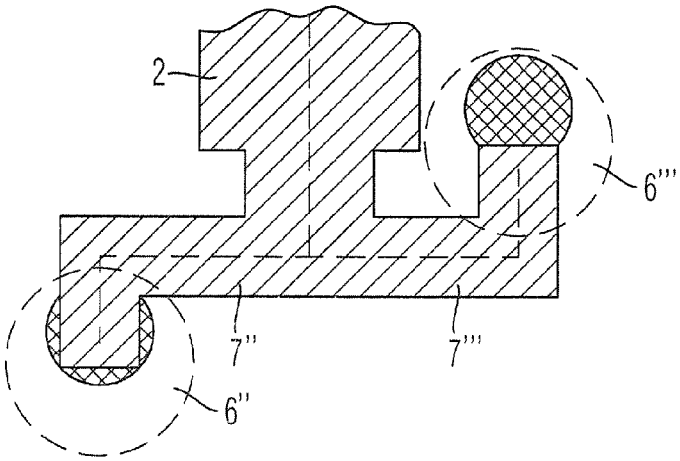
Figure 9A:
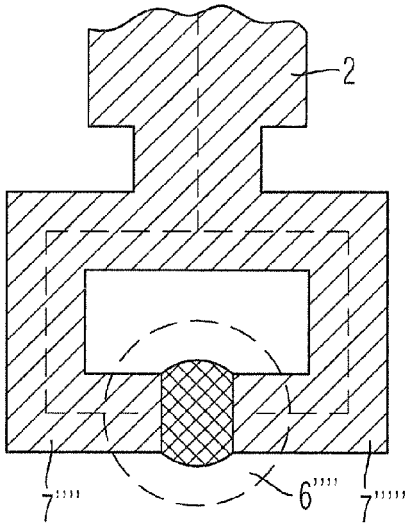
Figure 9B:
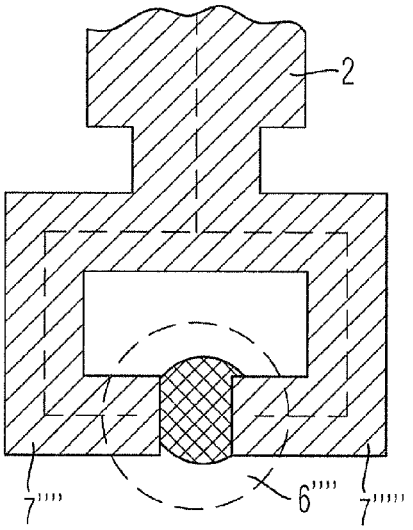
Figure 9C:
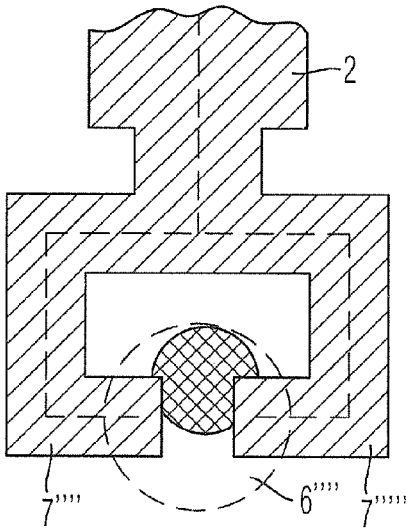
Figure 10A:
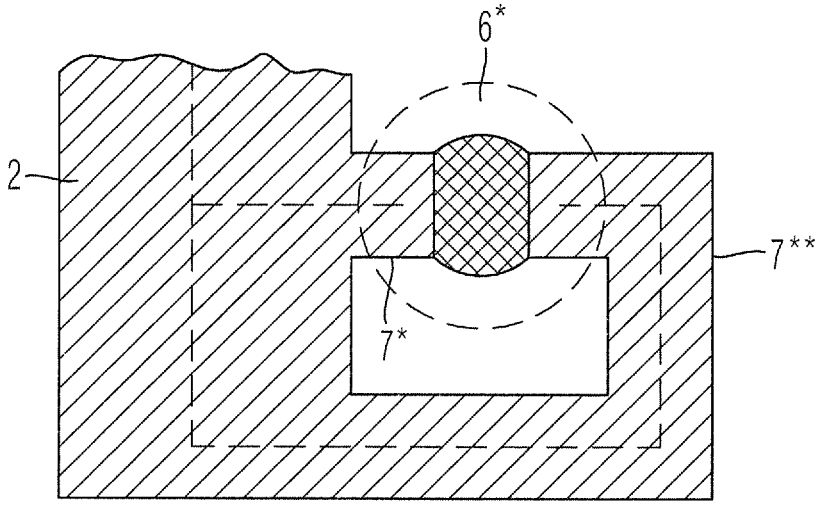
Figure 10B:
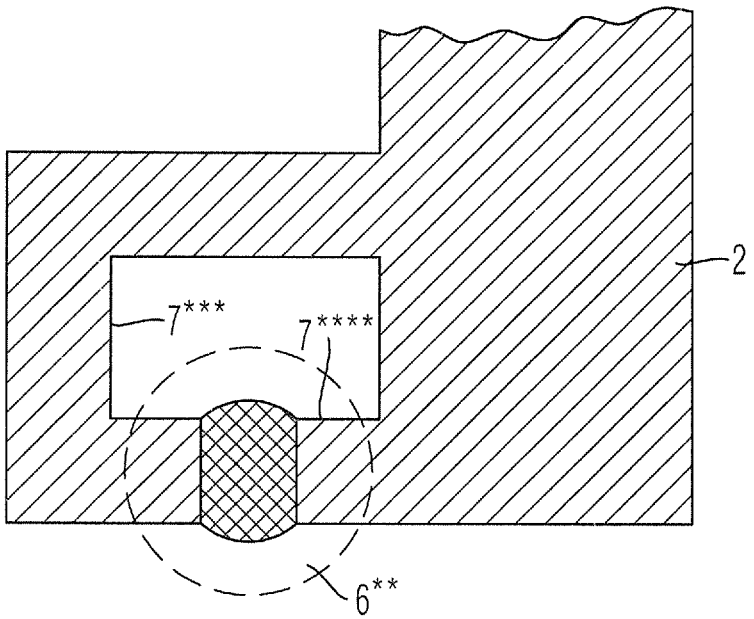
Figure 11:
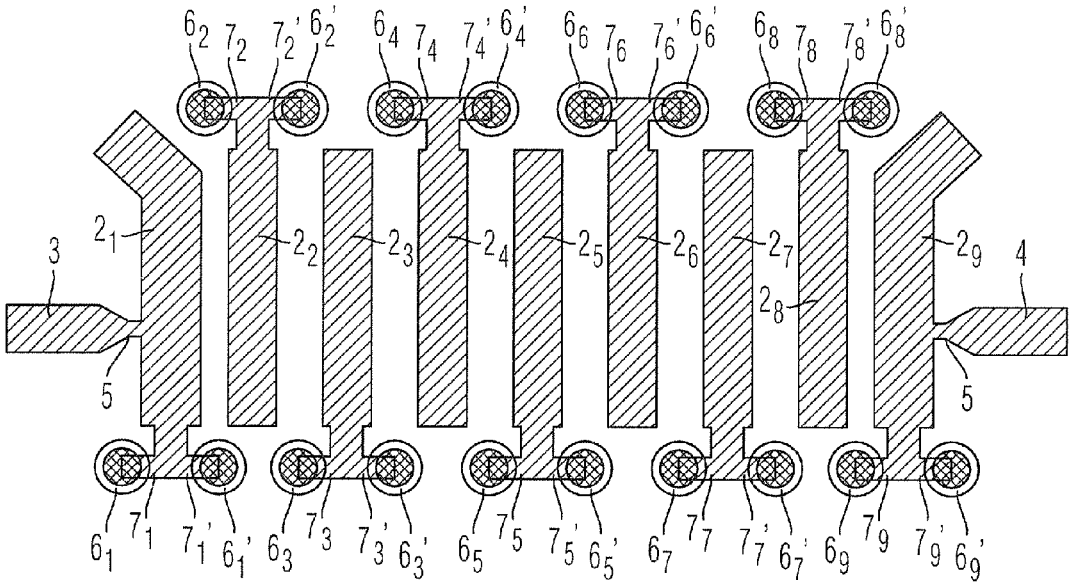
Figure 12:
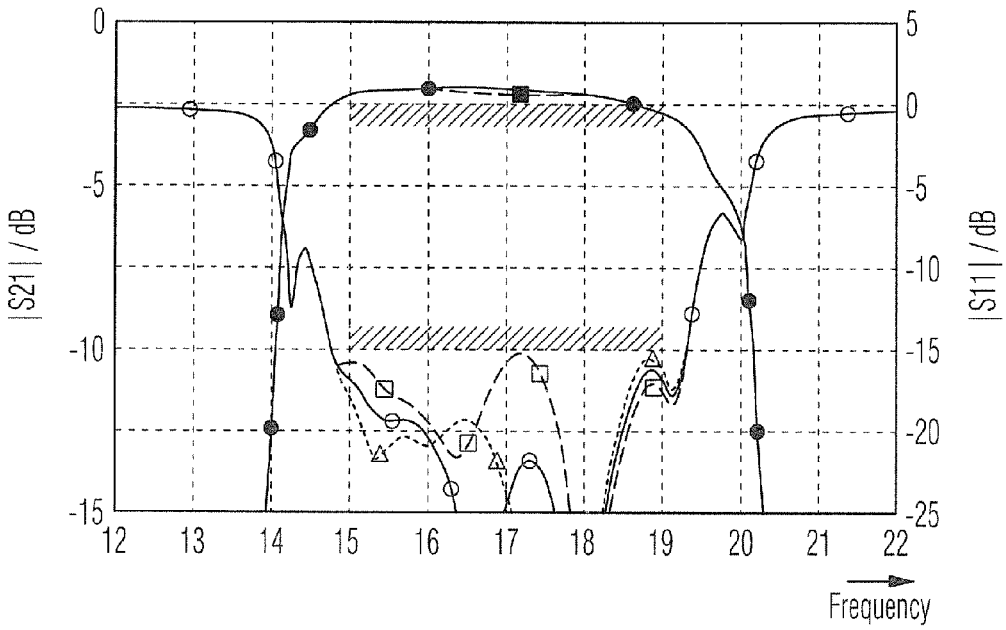

Embodiments of the inventive microwave circuit are described in detail referring to the drawings. The figures of the drawings show:

FIG. 1 a microwave circuit as an interdigital filter,

FIG. 2 a microwave circuit as an interdigital filter with deviations of the vias, FIG. 3A a frequency response of the transmission characteristic of an interdigital filter without any deviations of the vias, FIG. 3B a frequency response of the transmission characteristic of an interdigital filter with deviations of the vias, FIG. 4 a frequency response of the insertion loss and of the return loss in case of missing deviations of the vias, in case of positive deviations of the vias and in case of negative deviations of the vias for the filter shown in FIG. 1, FIG. 5A a first embodiment of a microwave circuit as an interdigital filter without any deviations of the vias, FIG. 5B a first embodiment of a microwave circuit as an interdigital filter with deviations of the vias, FIG. 6A a second embodiment of a microwave circuit as an interdigital filter without any deviations of the vias, FIG. 6B a second embodiment of a microwave circuit as an interdigital filter with deviations of the vias, FIG. 7A an extension resonator strip in a third embodiment of a microwave circuit as an interdigital filter without any deviations of the vias, FIG. 7B an extension resonator strip in a third embodiment of a microwave circuit as an interdigital filter with horizontal deviations of the vias, FIG. 7C an extension resonator strip in a third embodiment of a microwave circuit as an interdigital filter with vertical deviations of the vias, FIG. 8A an extension resonator strip in a fourth embodiment of a microwave circuit as an interdigital filter without any deviations of the vias, FIG. 8B an extension resonator strip in a fourth embodiment of a microwave circuit as an interdigital filter with horizontal deviations of the vias, FIG. 8C an extension resonator strip in a fourth embodiment of a microwave circuit as an interdigital filter with vertical deviations of the vias, FIG. 9A an extension resonator strip in a fifth embodiment of a microwave circuit as an interdigital filter without any deviations of the vias, FIG. 9B an extension resonator strip in a fifth embodiment of a microwave circuit as an interdigital filter with horizontal deviations of the vias, FIG. 9C an extension resonator strip in a fifth embodiment of a microwave circuit as an interdigital filter with vertical deviations of the vias, FIG. 10A an extension resonator strip of a sixth embodiment of a microwave circuit as an interdigital filter FIG. 10B an extension resonator strip of a seventh embodiment of a microwave circuit as an interdigital filter FIG. 11 the third embodiment of the complete microwave circuit as an interdigital filter and FIG. 12 a frequency response of the insertion loss and of the return loss of an inventive microwave circuit in case of missing deviations of the vias, in case of positive deviations of the vias and in case of negative deviations of the vias for the inventive filter shown in FIG. 11.

In the first embodiment of the invention according to FIGS. 5A and 5B the microwave circuit 1 is an interdigital filter of $9^{th}$ order comprising 9 parallel oriented metallic resonator strips $\mathbf{2}_1,\mathbf{2}_2,\ldots$ and $\mathbf{2}_9$ on one surface of a layer substrate. The first resonator strip $\mathbf{2}_1$ on the left side of the interdigital filter in FIGS. 5A and 5B is connected to an input strip line 3 and the $9^{th}$ resonator strip $\mathbf{2}_9$ on the right side of the interdigital filter is connected to an output strip line 4. Input strip line 3 and output strip line 4 are optimally matched to the microwave circuit 1 by means of a tap 5.

At one end of each resonator strip $\mathbf{2}_1,\mathbf{2}_2,\ldots$ and $\mathbf{2}_9$ a corresponding via $\mathbf{6}_1,\mathbf{6}_2,\ldots$ and $\mathbf{6}_9$ connecting the corresponding resonator $\mathbf{2}_1,\mathbf{2}_2,\ldots$ and $\mathbf{2}_9$ to a ground contact on the opposite surface of the layer substrate is positioned. The end of each second resonator strip $\mathbf{2}_1,\mathbf{2}_2,\ldots$ and $\mathbf{2}_9$—i.e. the resonator strips $\mathbf{2}_2,\mathbf{2}_4,\mathbf{2}_6$ and $\mathbf{2}_8$ in the configuration shown in FIGS. 5A and 5B—are elongated and are loop-shaped. The open end of the looped-shaped elongated end of each second resonator strip $\mathbf{2}_2,\mathbf{2}_4,\mathbf{2}_6$ and $\mathbf{2}_8$ is connected to a via $\mathbf{6}_2,\mathbf{6}_4,\mathbf{6}_6$ and $\mathbf{6}_8$ and is positioned opposite to the former second resonator strip $\mathbf{2}_2,\mathbf{2}_4,\mathbf{2}_6$ and $\mathbf{2}_8$ which do not have any elongation. Thus, each via $\mathbf{6}_2,\mathbf{6}_4,\mathbf{6}_6$ and $\mathbf{6}_8$ connected to each second resonator strip $\mathbf{2}_2,\mathbf{2}_4,\mathbf{2}_6$ and $\mathbf{2}_8$ is positioned to the corresponding resonator strip $\mathbf{2}_2,\mathbf{2}_4,\mathbf{2}_6$ and $\mathbf{2}_8$ in the same direction as each via $\mathbf{6}_1,\mathbf{6}_3,\mathbf{6}_5,\mathbf{6}_7$ and $\mathbf{6}_9$ connected to each first resonator strip $\mathbf{2}_1,\mathbf{2}_3,\mathbf{2}_5,\mathbf{2}_7$ and $\mathbf{2}_9$. In the configuration of FIGS. 5A and 5B each via $\mathbf{6}_1,\mathbf{6}_2,\mathbf{6}_3,\mathbf{6}_4,\mathbf{6}_5,\mathbf{6}_6,\mathbf{6}_7,\mathbf{6}_8$ and $\mathbf{6}_9$ is positioned below the corresponding resonator strip $\mathbf{2}_1,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$.

The degradation of the effective electrical length in each resonator strip $\mathbf{2}_2,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$ (see the dotted line for the effective electrical length in each resonator strip $\mathbf{2}_2,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$) is identical in each resonator strip $\mathbf{2}_2,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$ for each deviation of the actual position (shown in FIG. 5B) of the vias $\mathbf{6}_1,\mathbf{6}_2,\mathbf{6}_3,\mathbf{6}_4,\mathbf{6}_5,\mathbf{6}_6,\mathbf{6}_7,\mathbf{6}_8$ and $\mathbf{6}_9$ in relation to the corresponding resonator strips $\mathbf{2}_2,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$ to the optimal position (shown in FIG. 5A) of the vias $\mathbf{6}_2,\mathbf{6}_2,\mathbf{6}_3,\mathbf{6}_4,\mathbf{6}_5,\mathbf{6}_6,\mathbf{6}_7,\mathbf{6}_8$ and $\mathbf{6}_9$ in relation to the corresponding resonator strips $\mathbf{2}_2,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$.

Thus, the identical degradation of the resonance frequency of each resonator strip $\mathbf{2}_2,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$ in the interdigital filter 1 results in a frequency response of the band pass filter characteristic of the microwave circuit 1 shown in FIG. 12. The insertion loss $S_{21}$ of the inventive microwave circuit shows a minimized drop in comparison to the insertion loss $S_{21}$ of the microwave circuit according to the filter shown in FIG. 1. According to FIG. 12 in comparison to FIG. 4 the return loss $S_{11}$ of the inventive microwave circuit is below −10 dB in comparison to the return loss $S_{11}$ of the microwave circuit according to FIG. 1 being only below −7 dB. The degradation of the resonance frequency of each resonator strip $\mathbf{2}_2,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$ in the interdigital filter 1 leads to a shift of the central frequency of the band pass filter.

In the second embodiment of the invention shown in FIG. 6A and FIG. 6B the end of each second resonator strip $\mathbf{2}_2,\mathbf{2}_4,\mathbf{2}_6$ and $\mathbf{2}_8$ is elongated ring-shaped. The open end of the ring-shaped elongated end of each second resonator strip $\mathbf{2}_2,\mathbf{2}_4,\mathbf{2}_6$ and $\mathbf{2}_8$ is connected to the corresponding via $\mathbf{6}_2,\mathbf{6}_4,\mathbf{6}_6$ and $\mathbf{6}_8$ and is positioned at the inner line of the ring-shaped elongated end opposite to the former second resonator strip $\mathbf{2}_2,\mathbf{2}_4,\mathbf{2}_6$ and $\mathbf{2}_8$ which does not have any elongation. Thus, in the second embodiment of the invention each via $\mathbf{6}_2,\mathbf{6}_4,\mathbf{6}_6$ and $\mathbf{6}_8$ connected to each second resonator strip $\mathbf{2}_2,\mathbf{2}_4,\mathbf{2}_6$ and $\mathbf{2}_8$ is also positioned to the corresponding resonator strip $\mathbf{2}_2,\mathbf{2}_4,\mathbf{2}_6$ and $\mathbf{2}_8$ in the same direction as the via $\mathbf{6}_1,\mathbf{6}_3,\mathbf{6}_5,\mathbf{6}_7$ and $\mathbf{6}_9$ connected to each first resonator strip $\mathbf{2}_1,\mathbf{2}_3,\mathbf{2}_5,\mathbf{2}_7$ and $\mathbf{2}_9$. In the configuration of FIGS. 6A and 6B each via $\mathbf{6}_1,\mathbf{6}_2,\mathbf{6}_3,\mathbf{6}_4,\mathbf{6}_5,\mathbf{6}_6,\mathbf{6}_7,\mathbf{6}_8$ and $\mathbf{6}_9$ is positioned below the corresponding resonator strip $\mathbf{2}_1,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$.

The degradation of the effective electrical length and of the resonance frequency in each resonator strip $\mathbf{2}_1,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$ is identical in each resonator strip $\mathbf{2}_1,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$ for each deviation of the actual position (as shown in FIG. 6B) of the vias $\mathbf{6}_1,\mathbf{6}_2,\mathbf{6}_3,\mathbf{6}_4,\mathbf{6}_5,\mathbf{6}_6,\mathbf{6}_7,\mathbf{6}_8$ and $\mathbf{6}_9$ in relation to the corresponding resonator strips $\mathbf{2}_1,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$ to the optimal position (shown in FIG. 6A) of the vias $\mathbf{6}_1,\mathbf{6}_2,\mathbf{6}_3,\mathbf{6}_4,\mathbf{6}_5,\mathbf{6}_6,\mathbf{6}_7,\mathbf{6}_8$ and $\mathbf{6}_9$ in relation to the corresponding resonator strips $\mathbf{2}_1,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$.

In the third, fourth, fifth, sixth and seventh embodiment of the invention, the end of each resonator strip $\mathbf{2}_1,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$ is split into two extension resonator strips. The open end of each extension resonator strip is connected to a via. The splitting of the end of each resonator strip $\mathbf{2}_1,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$ into two extension resonator strips results in two paths for the effective electrical length of each resonator strip $\mathbf{2}_1,\mathbf{2}_2,\mathbf{2}_3,\mathbf{2}_4,\mathbf{2}_5,\mathbf{2}_6,\mathbf{2}_7,\mathbf{2}_8$ and $\mathbf{2}_9$.

In the third, fourth and fifth embodiment of the invention, the two extension resonator strips have an identical form and identical size. Furthermore, in the third and fourth embodiment of the invention, the two extension resonator strips are positioned point-symmetric to the end of the preceding resonator strip, whereas in the fifth embodiment of the invention two extension resonator strips are positioned axis-symmetric to the axis of the resonator strip. Taking into account these criteria of construction the effective electrical lengths of the elongated resonator strips each comprising the preceding resonator strip and one extension resonator strip are symmetric to the averaged effective electrical length of the elongated resonator strip as the combination of the preceding resonator strip and the two extension resonator strips for each position of the at least one via in relation to the corresponding resonator strip.

In the third embodiment of the invention shown in FIGS. 7A to 7C, wherein each figure presents a different position of the vias 6 and 6' relative to the resonator strip 2 the two extension resonator strips 7 and 7' are two extension resonator strips 7 and 7' disposed perpendicularly to the resonator strip 2 in opposite direction to each other. Thus, the preceding resonator strip 2 and the two extension resonator strips 7 and 7' are positioned in a T-shaped orientation.

In the case of an optimal position of the vias 6 and 6' in relation to the corresponding resonator strip 2 shown in FIG. 7A, the effective electrical lengths of the elongated resonator strips each comprising the preceding resonator strip and one of these extension resonator strips (see dotted line in FIG. 7A) are identical because the area of contact between the via 6 and 6' and the corresponding extension resonator strip 7 and 7' are identical. The identical effective electrical lengths of the elongated resonator strips each comprising the preceding resonator strip and one of these extension resonator strips result in an averaged effective electrical length of the elongated resonator strip 2, which corresponds to the effective electrical length of the elongated resonator strip comprising the preceding resonator strip and one of these extension resonator strips.

In the case of vias 6 and 6' whose actual positions are deviated from the optimal positions in the upper direction according to FIG. 7B, the effective electrical lengths of the elongated resonator strip 2 each comprising the preceding resonator strip and one of these extension resonator strips are also identical because the area of contact between the via 6 and 6' and the corresponding extension resonator strip 7 and 7' are also identical. The identical effective electrical lengths of the elongated resonator strip each comprising the preceding resonator strip 2 and one of these extension resonator strips 7 and 7' result in an averaged effective electrical length of the elongated resonator strip which corresponds to the effective electrical length of the elongated resonator strip comprising the preceding resonator strip 2 and one of these extension resonator strips 7 and 7'.

In the case of vias 6 and 6' whose positions are deviated from the optimal position relative to the elongated resonator strip in the left direction according to FIG. 7C, the effective electrical lengths of the elongated resonator strip comprising the preceding resonator strip 2 and the left-sided extension resonator strip 7 is larger than the effective electrical lengths of the elongated resonator strip comprising the preceding resonator strip 2 and the right-sided extension resonator strip 7'. This effect is caused by the fact that the area of contact between the via 6 and the left-sided extension resonator strip 7 is reduced in comparison to the case shown in FIG. 7A leading to a propagation of the microwave until the end of the left-sided extension resonator strip 7, whereas the area of contact between the via 6' and the right-sided extension resonator strip 7' is enlarged enabling a shorter propagation of the microwave in the right-sided extension resonator strip 7' on the path to the mass contact. The effective electrical length of the elongated resonator strip comprising the preceding resonator strip 2 and the left-sided extension resonator strip 7 and the effective electrical length of the elongated resonator strip comprising the preceding resonator strip 2 and the right-sided extension resonator strip 7' are symmetric to the averaged effective electrical length of the elongated resonator strip leading in combination to an averaged effective electrical length of the elongated resonator strip which is identical to the averaged effective electrical length of the elongated resonator strip in the cases shown in FIG. 7A and FIG. 7B.

The third embodiment of the inventive microwave circuit is an interdigital filter of $9^{th}$ order with nine parallel resonator strips $\mathbf{2}_1,\mathbf{2}_2,\mathbf{2}_3,\mathbf{2}_4,\mathbf{2}_5,\mathbf{2}_6,\mathbf{2}_7,\mathbf{2}_8,\mathbf{2}_9$ each having two extension resonator strips $7_1,7_2,7_3,7_4,7_5,7_6,7_7,7_8,7_9$ and $7_1',7_2',7_3',7_4',7_5',7_6',7_7',7_8',7_9'$ connected to the corresponding vias $\mathbf{6}_1,\mathbf{6}_2,\mathbf{6}_3,\mathbf{6}_4,\mathbf{6}_5,\mathbf{6}_6,\mathbf{6}_7,\mathbf{6}_8,\mathbf{6}_9$ and $\mathbf{6}_2',\mathbf{6}_2',\mathbf{6}_3',\mathbf{6}_4',\mathbf{6}_5',\mathbf{6}_6',\mathbf{6}_7',\mathbf{6}_8',\mathbf{6}_9'$ at one alternating end. This is shown in FIG. 11.

In the fourth embodiment of the invention shown in FIG. 8A to 8C, wherein each figure presents a different position of the vias 6 and 6' relative to the resonator strip 2, the two extension resonator strips 7" and 7''' are two extension resonator strips 7" and 7''' each having an parallel orientation to the preceding resonator strip 2 at the portion of the open end. Furthermore, one extension resonator strip 7''' has an equal orientation to the preceding resonator strip 2 and the other extension resonator strip 7" has an opposite orientation to the preceding resonator strip 2. The identical form of each extension resonator strips 7" and 7''' may vary from a perpendicular form as shown in FIG. 8A to 8C to a rounded or curved form.

In the case of an optimal position of the vias 6" and 6''' in relation to the corresponding resonator strip 2 shown in FIG. 8A the effective electrical lengths of the elongated resonator strip each comprising the preceding resonator strip 2 and one of these extension resonator strips 7" and 7''' are identical because the areas of contact between the via 6" and 6''' and the corresponding extension resonator strip 7" and 7''' are identical. The identical effective electrical lengths of the elongated resonator strip each comprising the preceding resonator strip 2 and one of these extension resonator strips 7" and 7''' result in an averaged effective electrical length of the elongated resonator strip, which corresponds to the effective electrical length of a elongated resonator strip comprising the preceding resonator strip 2 and one extension resonator strip 7" or 7'''.

In the case of vias 6" and 6''' whose actual positions are deviated from the optimal position in the left direction according to FIG. 8B, the effective electrical lengths of the elongated resonator strips each comprising the preceding resonator strip 2 and one of these extension resonator strips 7" or 7''' are also identical because the area of contact between the via 6" and 6''' and the corresponding extension resonator strip 7" and 7''' are also identical. The identical effective electrical lengths of the elongated resonator strip each comprising the preceding resonator strip 2 and one of these extension resonator strips 7" and 7''' result in an averaged effective electrical length of the elongated resonator strip, which corresponds to the effective electrical length of the elongated resonator strip comprising the preceding resonator strip 2 and one extension resonator strip 7" and 7'''.

In the case of vias 6" and 6''' whose actual positions are deviated from the optimal position in the upper direction according to FIG. 8C, the effective electrical length of the elongated resonator strip comprising the preceding resonator strip 2 and the right-sided extension resonator strip 7''' is larger than the effective electrical length of the elongated resonator strip comprising the preceding resonator strip 2 and the left-sided extension resonator strip 7". This effect is caused by the fact that the area of contact between the via 6''' and the right-sided extension resonator strip 7''' is reduced in comparison to the case shown in FIG. 8A leading to a propagation of the microwave until the end of the right-sided extension resonator strip 7''', whereas the area of contact between the via 6" and the left-sided extension resonator strip 7" is enlarged enabling a shorter propagation of the microwave in the left-sided extension resonator strip 7" on the path to the mass contact. The effective electrical length of the elongated resonator strip comprising the combination of the preceding resonator strip 2 and of the right-sided extension resonator strip 7''' and the effective electrical length of the elongated resonator strip comprising the combination of the preceding resonator strip 2 and of the left-sided extension resonator strip 7" are symmetric to the averaged effective electrical length of the elongated resonator strip leading in combination to an averaged effective electrical length of the elongated resonator strip, which is identical to the averaged effective electrical length of the elongated resonator strip in the cases shown in FIG. 8A and FIG. 8B.

In the fifth embodiment of the invention shown in FIG. 9A to 9C, wherein each figure presents a different position of the common via 6"" relative to the resonator strip 2, the two extension resonator strips 7"" and 7""" are two extension resonator strips 7"" and 7"", which represent two identical halves of a ring-shaped resonator strip, whereby the open end of each extension resonator strip 7"" and 7""" is connected to a different section of a common via 6"". The identical form of each extension resonator strips 7"" and 7""" may vary from a perpendicular form as shown in FIGS. 9A to 9C to a rounded or curved form.

In the case of an optimal position of the common via 6"" in relation to the corresponding resonator strip 2 shown in FIG. 9A, the effective electrical lengths of the elongated resonator strip each comprising the preceding resonator strip 2 and one of these extension resonator strips 7"" or 7""" are identical because the areas of contact between the common via 6"" and the extension resonator strips 7"" and 7""" are identical. The identical effective electrical lengths of the elongated resonator strips each comprising the preceding resonator strip 2 and one of these extension resonator strips 7"" and 7""" result in an averaged effective electrical length of the elongated resonator strip, which corresponds to the effective electrical length of a elongated resonator strip comprising the preceding resonator strip 2 and one extension resonator strip 7'''' and 7'''''.

In the case of a common via 6'''' whose position is deviated from the optimal position relative to the resonator strip 2 in the right direction according to FIG. 9B, the effective electrical length of the elongated resonator strip comprising the preceding resonator strip 2 and the left-sided extension resonator strip 7'''' is larger than the effective electrical length of the elongated resonator strip comprising the preceding resonator strip 2 and the right-sided extension resonator strip 7'''''. This effect is caused by the fact that the area of contact between the common via 6'''' and the left-sided extension resonator strip 7'''' is reduced in comparison to the case shown in FIG. 9A leading to a propagation of the microwave to the end of the left-sided extension resonator strip 7'''', whereas the area of contact between the common via 6'''' and the right-sided extension resonator strip 7''''' is enlarged enabling a shorter propagation of the microwave in the right-sided extension resonator strip 7''''' on the path to the ground contact. The effective electrical length of the elongated resonator strip comprising the combination of the preceding resonator strip 2 and of the right-sided extension resonator strip 7''''' and the effective electrical length of the elongated resonator strip comprising the combination of the preceding resonator strip 2 and of the right-sided extension resonator strip 7''''' are symmetric to the averaged effective electrical length of the elongated resonator strip leading in combination to an averaged effective electrical length of the elongated resonator strip, which is identical to the averaged effective electrical length of the elongated resonator strip in the case shown in FIG. 9A.

In the case of common via 6'''' whose position is deviated from the optimal position relative to the resonator strip 2 in the upper direction according to FIG. 9C, the effective electrical lengths of the elongated resonator strips each comprising the preceding resonator strip 2 and one of these extension resonator strips 7'''' or 7''''' are also identical because the area of contact between the common via 6'''' and the corresponding extension resonator strip 7'''' and 7''''' are also identical. The identical effective electrical lengths of the elongated resonator strips each comprising the preceding resonator strip 2 and one of these extension resonator strips 7'''' or 7''''' result in an averaged effective electrical length of the elongated resonator strip, which corresponds to the effective electrical length of the elongated resonator strip comprising the preceding resonator strip 2 and one extension resonator strip 7'''' or 7'''''.

In the sixth and seventh embodiment of the invention the two extension resonator strips of each resonator strip $\mathbf{2}_2$,$\mathbf{2}_2$, $\mathbf{2}_3$,$\mathbf{2}_4$,$\mathbf{2}_5$,$\mathbf{2}_6$,$\mathbf{2}_7$,$\mathbf{2}_8$ and $\mathbf{2}_9$ in FIGS. 10A and 10B do not have any identical form. The first extension resonator strip 7* of the sixth embodiment of the invention in FIG. 10A and the second extension resonator strip 7 the seventh embodiment of the invention in FIG. 10B each represent a quarter of a ring-shaped resonator, whereas the second extension resonator strip 7** of the sixth embodiment of the invention in FIG. 10A and the first extension resonator strip 7*** of the seventh embodiment of the invention in FIG. 10B each represent three quarters of a ring-shaped resonator. The form of each first and second extension resonator strip 7*, 7**, 7*** and 7** may vary from a perpendicular form as shown in FIGS. 10A and 10B to a rounded or curved form. The open end of each first and second extension resonator strip in the sixth and seventh embodiment of the invention is connected to a different section of a common via 6* and 6****.

For each position of the common via 6* and 6 relative to the resonator strip 2**, the averaged effective electrical length of the elongated resonator strip in the sixth and seventh embodiment of the invention is identical and/or constant. The arguments for this effect are the same as stated above for the third, fourth and fifth embodiment of the invention.

The invention is not limited to the disclosed embodiments. The combinations of all the features claimed in the claims of all the features disclosed in the description and all the features designed in the figures of the drawing are within the scope of the invention.

The invention claimed is:

1. Microwave circuit in strip line technology, comprising:

metallic resonator strips on one side of a dielectric layer, whereby alternately an opposite end of one of said consecutive resonator strips is connected through at least one via to a metallic surface on an opposite side of said dielectric layer, wherein said end of each resonator strip is formed relative to said at least one via so that an effective electrical length of each of said resonator strips connected through said via is identical for all resonator strips independent of an exact position of said via;

wherein said end of each resonator strip is formed relative to a position of its corresponding via such that the end of each resonator strip is positioned in a same direction relative to its corresponding via; and wherein an end of each second consecutive resonator strip is loop-shaped and elongated so that an identical deviation of each via in relation to its corresponding resonator strip leads to an identical shift in the effective electrical length of each resonator strip in combination with its via for all directions of the deviation.

2. Microwave circuit according to claim 1, wherein said end of each second consecutive resonator strip is terminated by an end being in a signal path next to the via and is located opposite to said resonator strip and is connected through said via.

3. Microwave circuit according to claim 1, wherein each said end that is loop-shaped and elongated is ring-shaped, whereby an open end of said ring-shaped elongated end is located opposite to said resonator strip at an inner line of said ring-shaped elongated end and is connected through said via.

4. Microwave circuit according to claim 1, wherein each said end that is loop-shaped and elongated is split into two extension resonator strips at an open end of each said extension resonator strip is connected to said at least one via, whereby the averaged enlargement of the effective electrical length of each resonator strip resulting from said two extension resonators strips is at least nearly identical for each position of said resonator strips relative to said at least one corresponding via.

5. Microwave circuit according to claim 4, wherein said two extension resonator strips each connected to said at least one via at said open end have an identical form and an identical size.

6. Microwave circuit according to claim 5, wherein said two extension resonator strips are halves of a ring-shaped resonator strip, wherein the open end of each extension resonator strip is connected to a different section of said at least one via.

7. Microwave circuit according to claim 4, wherein said two extension resonator strips are halves of a ring-shaped resonator strip, wherein the open end of each extension resonator strip is connected to a different section of said at least one via.

* * * * *